US005494405A

United States Patent [19]

Gray et al.

[11] Patent Number: 5,494,405

[45] Date of Patent: Feb. 27, 1996

[54] METHOD OF MODIFYING A STEAM TURBINE

[75] Inventors: Lewis Gray; John C. Groenendaal, Jr., both of Winter Springs, Fla.

[73] Assignee: Westinghouse Electric Corporation, Pittsburgh, Pa.

[21] Appl. No.: 407,204

[22] Filed: Mar. 20, 1995

[51] Int. Cl.[6] ..... F01D 25/24

[52] U.S. Cl. ..... 415/211.2; 415/215.1

[58] Field of Search ..... 415/208.1, 211.2, 415/215.1, 220, 912; 29/889, 889.1, 889.2, 889.22

[56] References Cited

U.S. PATENT DOCUMENTS

| | | | |
|---|---|---|---|
| 3,058,720 | 10/1962 | Hart et al. . | |
| 3,594,094 | 7/1971 | Engelke et al. | 415/111 |
| 3,690,786 | 9/1972 | Silvestri, Jr. . | |
| 3,697,191 | 10/1972 | Heymann . | |
| 3,945,760 | 3/1976 | Miller | 415/189 |
| 3,973,870 | 10/1976 | Desai . | |
| 3,982,849 | 9/1976 | Bernasconi et al. | 415/101 |
| 4,214,452 | 7/1980 | Riollet et al. | 60/697 |
| 4,390,319 | 6/1983 | Garkusha et al. . | |
| 4,391,564 | 7/1983 | Garkusha et al. | 415/126 |
| 4,398,865 | 8/1983 | Garkusha et al. | 415/148 |
| 4,421,454 | 12/1983 | Wosika | 415/117 |
| 4,435,121 | 3/1984 | Wosika . | |
| 4,770,603 | 9/1988 | Engels et al. | 415/147 |
| 4,802,821 | 2/1989 | Krietmeier . | |
| 4,863,341 | 9/1989 | Groenendaal | 415/103 |
| 4,900,223 | 2/1990 | Groenendaal, Jr. | 415/190 |
| 4,915,581 | 4/1990 | Groenendaal, Jr. et al. | 415/213.1 |
| 4,948,335 | 8/1990 | Silvestri, Jr. | 415/169.2 |
| 5,102,298 | 4/1992 | Kreitmeier | 415/211.2 |
| 5,104,288 | 4/1992 | Groenendaal, Jr. et al. | 415/209.3 |
| 5,110,256 | 5/1992 | Groenendaal, Jr. | 415/190 |
| 5,149,248 | 9/1992 | Cramer | 415/169.2 |
| 5,174,120 | 12/1992 | Silvestri, Jr. | 60/692 |
| 5,199,264 | 4/1993 | Viscovich | 60/679 |
| 5,203,673 | 4/1993 | Evans | 415/173.2 |
| 5,231,832 | 8/1993 | Tarman | 60/692 |
| 5,257,906 | 11/1993 | Gray et al. | 415/226 |
| 5,269,648 | 12/1993 | Freuschle | 415/148 |
| 5,338,155 | 8/1994 | Kreitmeier | 415/211.2 |

FOREIGN PATENT DOCUMENTS

| | | | |
|---|---|---|---|
| 418887A | 3/1991 | European Pat. Off. . | |
| 61-160502 | 7/1986 | Japan | 415/215.1 |

*Primary Examiner*—Edward K. Look
*Assistant Examiner*—James A. Larson
*Attorney, Agent, or Firm*—M. G. Panian

[57] ABSTRACT

A steam turbine having improved stationary parts in which a moisture removal slot is formed in a blade ring cylinder immediately upstream of the last row of rotating blades. The slot has a reduced width inlet throat portion and an enlarged manifold portion. The manifold portion of the slot distributes the moisture collected to a plurality of radially oriented discharge holes formed in the blade ring. The inlet throat serves to insolate the manifold from the swirling steam flowing through the turbine, thereby preventing entrainment of the moisture droplets into the steam flow. The blade ring encircles the tips of the last row of rotating blades and the outer flow guide is integrally formed on the blade ring. The steam turbine also has a new inner flow guide that matches a new last row of rotating blades. The new inner flow guide is attached to the existing inner flow guide by welds.

1 Claim, 4 Drawing Sheets

METHOD OF MODIFYING A STEAM TURBINE

BACKGROUND OF THE INVENTION

The present invention relates to an improved steam turbine. More specifically, the present invention relates to improvements in the stationary parts of a steam turbine, specifically, the cylinder and the inner flow guide of the exhaust diffuser.

The steam flow path of a steam turbine is formed by a stationary inner cylinder and a rotor. A large number of stationary vanes are attached to the inner cylinder in a circumferential array and extend inward into the steam flow path. Similarly, a large number of rotating blades are attached to the rotor in a circumferential array and extend outward into the steam flow path. The stationary vanes and rotating blades are arranged in alternating rows so that a row of vanes and the immediately downstream row of blades form a stage. The vanes serve to direct the flow of steam so that it enters the downstream row of blades at the correct angle. The blade airfoils extract energy from the steam, thereby developing the power necessary to drive the rotor and the load attached to it.

As the steam flows through the turbine its pressure drops through each succeeding stage until the desired discharge pressure is achieved. Thus, the steam properties—that is, temperature, pressure, velocity and moisture content—vary from row to row as the steam expands through the flow path. At certain locations within the flow path, especially immediately upstream of the last row of rotating blades in a low pressure steam turbine, the steam may be "wet." Under wet steam conditions, water droplets may condense on the stationary vanes adjacent the inner cylinder. Such water droplets may be swept from the inner cylinder into the steam flow and impact the downstream row of rotating blades. Such impact can result in erosion and subsequent weakening of the rotating blades.

In order to improve the thermodynamic performance of the steam turbine exhaust system, an exhaust diffuser is employed. One such exhaust diffuser is shown in U.S. Pat. No. 5,257,906 (Gray et al.). The exhaust diffuser is comprised of inner and outer flow guides. The outer flow guide is typically attached to the blade ring portion of the inner cylinder by means of a bolted vertical flange, although outer flow guides that are integral with the blade ring have also been used. Traditionally, the tips of the last row of rotating blades are enclosed by the flanged area of the outer flow guide. Moisture is typically removed from the steam immediately upstream of the last row of rotating blades by means of a gap formed between the inner cylinder and the flange of the outer flow guide— see, for example, U.S. Pat. Nos. 5,149,248 (Cramer), 4,948,335 (Silvestri), and 3,058,720 (Hart et al.).

Unfortunately, because of the need for small radial clearance between the tips of the rotating blades and the outer flow guide, this approach requires that the outer flow guide be very accurately aligned to the inner cylinder. The need for such careful alignment complicates the manufacture and assembly of the steam turbine.

It has been proposed that a circumferential slot, connected to radial discharge holes, be used for moisture removal in the upstream stages of a steam turbine—see U.S. Pat. No. 3,973,870 (Desai). In this approach, the width of the slot must be fairly large in order to provide sufficient area for the inlets of the discharge holes so as to prevent the accumulation of excessive moisture within the slot. Unfortunately, the swirling of the steam into such a large width slot can result in moisture being entrained into the steam flowing downstream of the blades, thereby defeating the purpose of the moisture removal.

It is therefore desirable to provide a moisture removal system in a steam turbine in which the danger of entrainment of moisture into the steam flow is minimized, as well as to provide a moisture removal system for the last row of rotating blades in a steam turbine that dispenses with the need for a gap between the outer flow guide and the inner cylinder.

The power output of an existing low pressure steam turbine can be increased by a retrofit which includes increasing the length of the last row of rotating blades. If the hub diameter of the new last row of rotating blades is changed, the original inner flow guide must be replaced by one that mates with the new blade row so as to provide a smooth path for the flow of steam. It is therefore desirable to provide a scheme for modifying an existing inner flow guide to match the hub diameter of a new set of last row rotating blades.

SUMMARY OF THE INVENTION

Accordingly, it is the general object of the current invention to provide a moisture removal system in a steam turbine in which the danger of entrainment of moisture into the steam flow is minimized, as well as to provide a moisture removal system for the last row of rotating blades in a steam turbine that dispenses with the need for a gap between the outer flow guide and the inner cylinder. It is another object of the invention to provide a scheme for modifying an existing inner flow guide to match the hub diameter of a new set of last row rotating blades.

Briefly, these objects, as well as other objects of the current invention, are accomplished in a steam turbine comprising (i) a rotor mounted for rotation and having a circumferentially extending row of rotating blades attached thereto, each of the rotating blades having a tip portion, and (ii) a cylinder enclosing at least a portion of the rotor, the cylinder and the rotor forming a flow path therebetween for directing a flow of steam through the steam turbine. The cylinder has (i) a radially inward facing surface encircling the tips of the rotating blades so that the cylinder surface and the blade tips define a clearance therebetween, (ii) a flow guide for directing the flow of steam away from the cylinder that is integrally formed with the cylinder and disposed downstream from the cylinder surface that encircles the blade tips, and (iii) means for removing moisture from the flow of steam, the moisture removing means comprising a circumferentially extending slot formed in the cylinder upstream from the cylinder surface.

In a preferred embodiment of the invention, the slot has (i) a manifold for collecting the flow of moisture removed from the flow of steam and for distributing the moisture to a plurality of discharge holes formed in the cylinder, and (ii) an inlet throat portion for isolating the manifold from the flow of steam so as to inhibit the moisture collected in the manifold from being entrained in the flow of steam.

Another embodiment of the invention is incorporated in a steam turbine having (i) a plurality of rows of rotating blades including a new last row of rotating blades having a hub diameter different from the diameter of the hub of the last row of rotating blades previously used in the steam turbine, and (ii) an existing flow guide for guiding a flow of steam away from the previously used last row of rotating blades.

The existing flow guide has an inlet diameter that matches the hub diameter of the previously used last row of rotating blades. According to this embodiment of the invention, the steam turbine is adapted to the new last row of rotating blades by welding a new flow guide to the existing flow guide. The new flow guide has an inlet diameter that matches the hub diameter of the new last row of rotating blades.

DESCRIPTION OF THE PREFERRED EMBODIMENT

Figure 1:
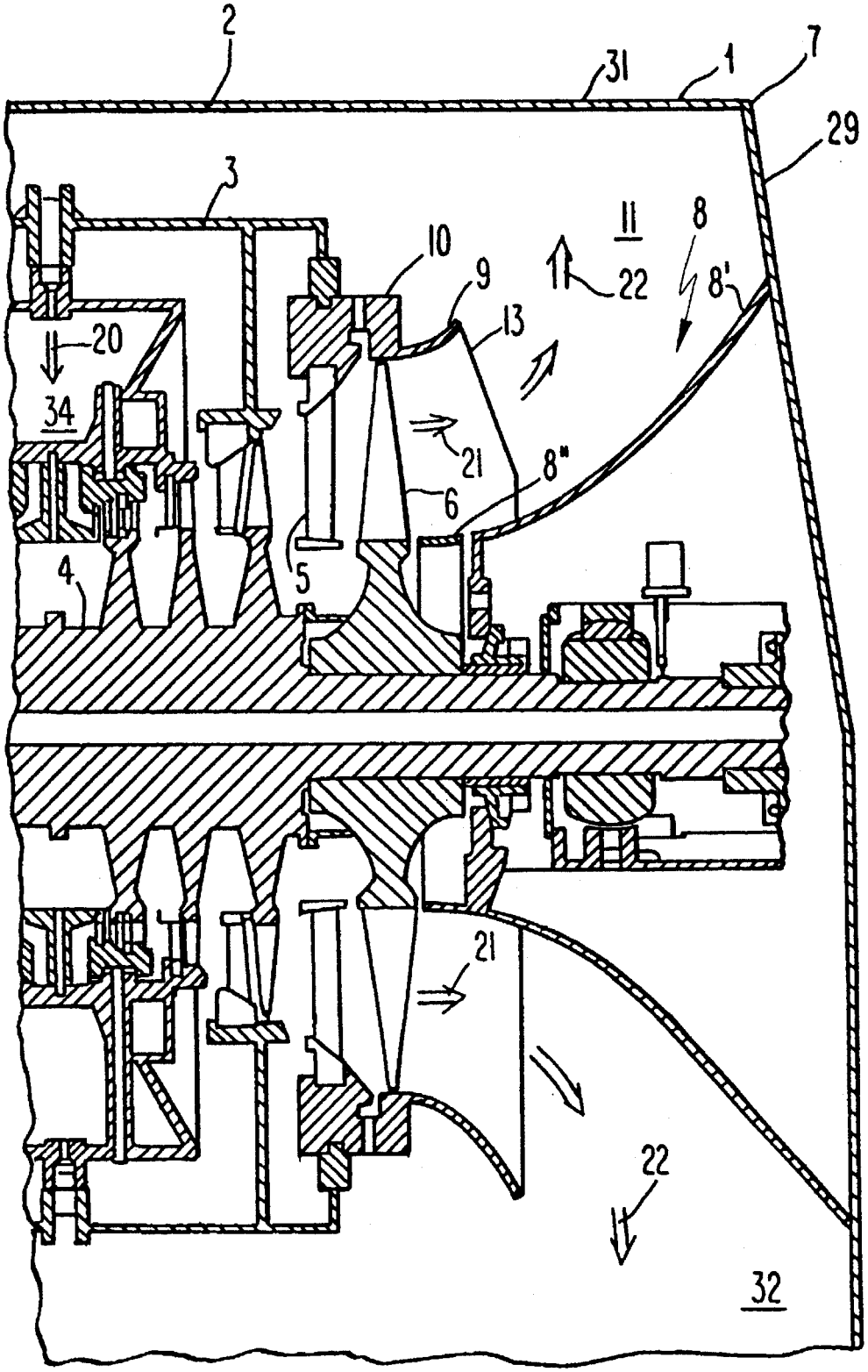
FIG. 1 is a portion of a longitudinal cross-section through a double ended low pressure steam turbine.

There is shown in FIG. 1 a longitudinal cross-section through the right hand end of a double ended low pressure steam turbine. The primary components of the steam turbine are an outer cylinder 2, an inner cylinder 3 enclosed by the outer cylinder, a centrally disposed rotor 4 enclosed by the inner cylinder and an exhaust system 1.

The inner cylinder 3 and rotor 4 form an annular steam flow path between themselves, the inner cylinder forming the outer periphery of the flow path. A plurality of stationary vanes and rotating blades, each of which has an airfoil portion that is exposed to the steam flow 20, are arranged in alternating rows and extend into the steam flow path. The vanes are affixed to the inner cylinder 3 and the blades are affixed to the periphery of the rotor 4. The last row of stationary vanes is indicated by reference numeral 5 and the last row of rotating blades—that is, the downstream most row—is indicated by reference numeral 6. As shown best in FIG. 2, the aft portion 10 of the inner cylinder 3, sometimes referred to as a "blade ring," has an inner surface 12 that encircles the tips 26 of the last row of blades 6. The radial gap between the blade tip 26 and the blade ring surface 12 is typically referred to as the blade "tip clearance" and is denoted in FIG. 2 by reference numeral 14. In order to minimize losses in the blade row, it is important that the tip clearance 14 be kept to a minimum.

As shown in FIG. 1, the exhaust system 1 is comprised of an exhaust housing 7 that extends from the turbine outer cylinder 2. Upper and lower portions of the exhaust housing 7 are joined along horizontal flanges (not shown). The exhaust housing 7 is formed by an end wall 29 that is connected to a rim 31. The rim 31 has the approximate shape of an inverted U.

An exhaust diffuser is disposed within the exhaust housing 7. The exhaust diffuser is formed by inner and outer flow guides 8 and 9, respectively. The inner and outer flow guides 8 and 9 form an approximately annular diffusing passage between themselves. According to the preferred embodiment of the current invention, the outer flow guide 9 is integrally formed with the blade ring 10— for example, by welding the outer flow guide to the blade ring. Consequently, there is no bolted joint connecting the outer flow guide 9 to the blade ring 10. The portion of the blade ring surface immediately downstream from surface 12 forms the inlet of the outer flow guide 9.

Figure 4:
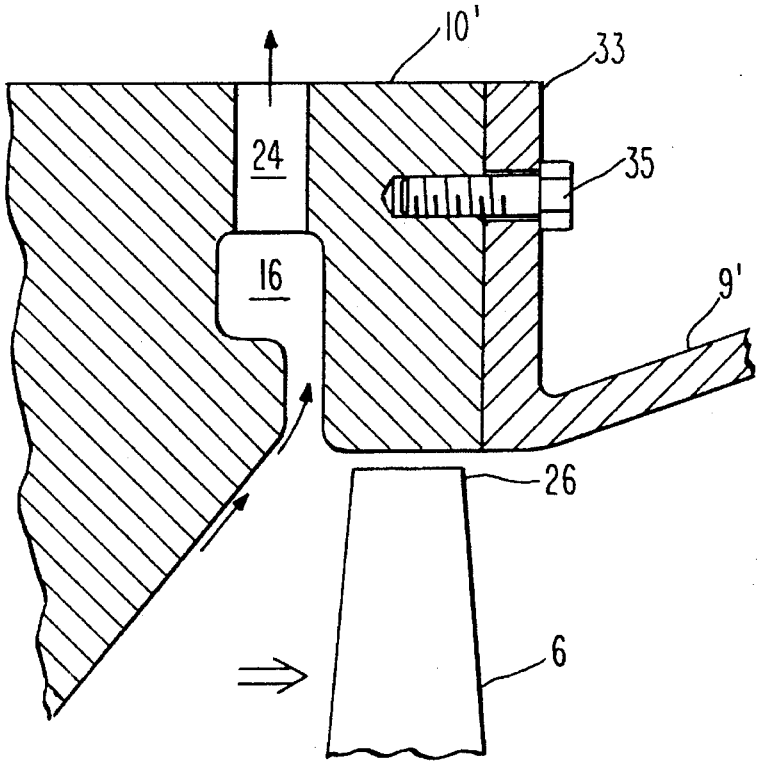
FIG. 4 is a view similar to FIG. 2 showing an alternate embodiment of the current invention.

Alternatively, a separate outer flow guide 9' could be used that is bolted to the blade ring 10' by means of a flange 33 and screws 35, as is conventional, as shown in FIG. 4. However, as discussed further below, it should be noted that in this embodiment as well, the blade ring 10', rather than the outer flow guide, encloses the rotating blade tips 26 so that certain advantages are achieved by the current invention even when such a bolted-on outer flow guide is used.

As shown in FIG. 1, the axial length of the outer flow guide 9 preferably varies around the circumference, being a minimum in the upper quadrant of its circumference and a maximum in the lower half of its circumference.

In traditional arrangements, in which the outer flow guide is attached to the blade ring by a bolted joint and the inner flow guide upper half is not axially segmented, the upper half of the exhaust housing 7 is removed at disassembly by first separating the upper half of the outer flow guide 9 from the blade ring 10. The top half of the exhaust housing 7, to which the upper half of the inner flow guide 8 is attached, can then be vertically lifted without interfering with the outer flow guide 9.

In the preferred embodiment, however, the outer flow guide 9 is integral with the blade ring 10 and, hence, cannot be removed without removing the blade ring. As is known in the prior art, the upper half of the inner flow guide 8 may be axially segmented into upstream 8" and downstream 8' portions, each of which is joined to the unsegmented lower half of the inner flow guide by a separate bolted joint (not shown). The axial length of the downstream segment 8' is such that its leading edge is disposed downstream from the trailing edge 13 of the outer flow guide 9 in the upper quadrant of the outer flow guide. The use of such a segmented inner flow guide upper half allows the top half of the exhaust housing 7, to which the downstream portion 8' of the inner flow guide upper half is attached, to be vertically lifted at disassembly without interfering with the integrally formed outer flow guide 9.

The exhaust housing 7, in conjunction with the inner and outer flow guides 8 and 9, respectively, forms an approximately horseshoe-shaped chamber 11. The chamber 11 has an outlet 32 in the bottom of the exhaust housing 7 that is connected to a condenser (not shown).

As shown in FIG. 1, in operation, high pressure steam 20 enters the steam turbine from an annular chamber 34 formed within the inner cylinder 3. The steam flow is then split into two streams, each flowing axially outward from the center of the steam turbine through the aforementioned steam flow path, thereby imparting energy to the rotating blades. The steam 21 discharges axially from the last row of blades 6 and enters the exhaust diffuser. The exhaust diffuser guides the steam 21 into the exhaust housing 7 over a 360° arc. The chamber 11 then directs the steam 22 to the exhaust housing outlet 32.

As is well known in the art, there is a tendency for moisture in the steam flowing through the steam turbine, especially in lowest pressure portions such as just upstream of the last row of rotating blades 6, to collect on the surfaces of the stationary vanes 5 and blade ring 10 so as to form water droplets. As previously discussed, these water droplets can become entrained in the steam flow and impact the rotating blades 6, causing harmful erosion. Therefore, it is important that moisture deposited by the steam be collected and removed before it can become entrained into the steam flow.

Figure 2:
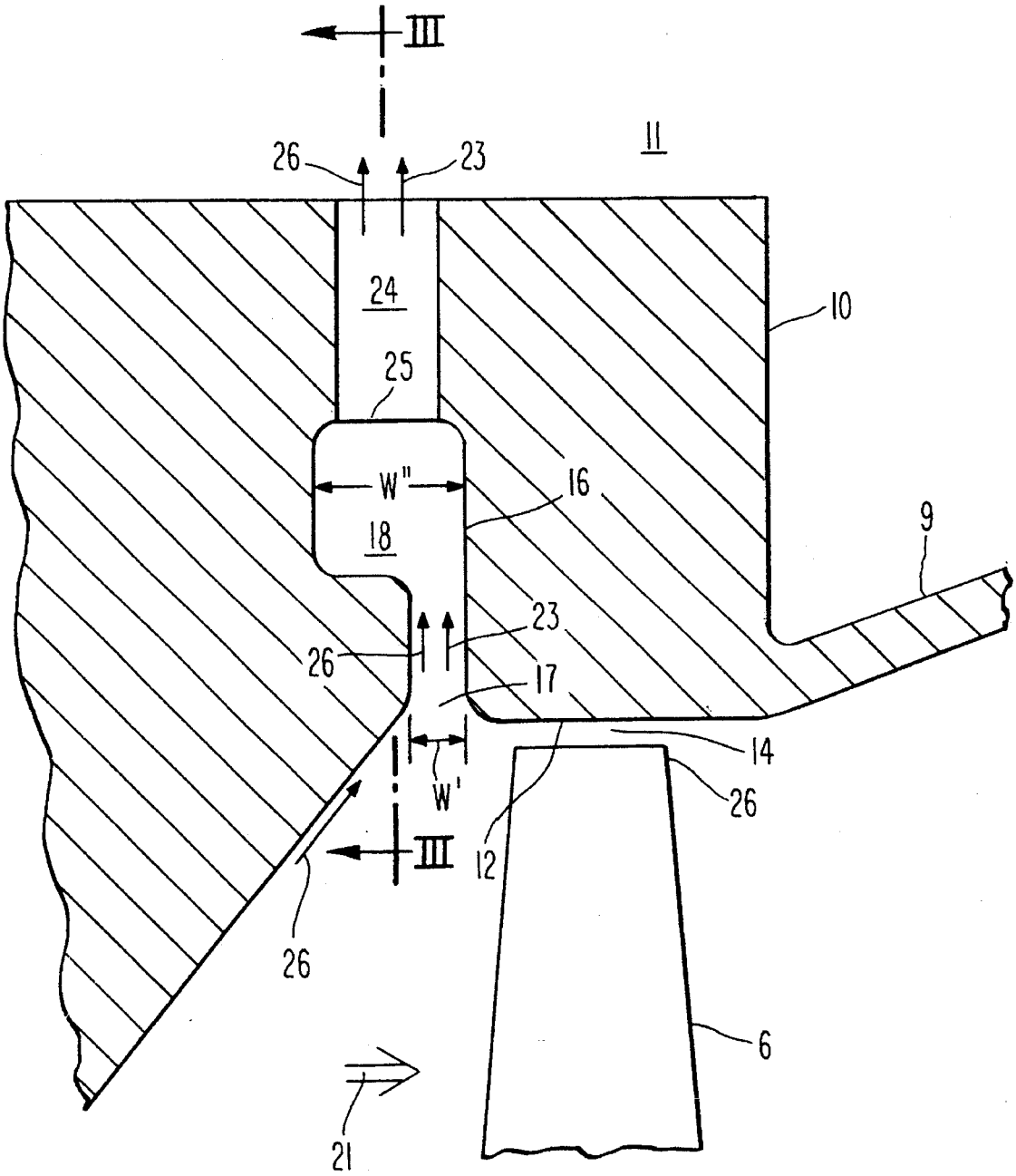
FIG. 2 is a detailed view of the steam turbine shown in FIG. 1 in the vicinity of the tips of the last row of rotating blades.
Figure 3:
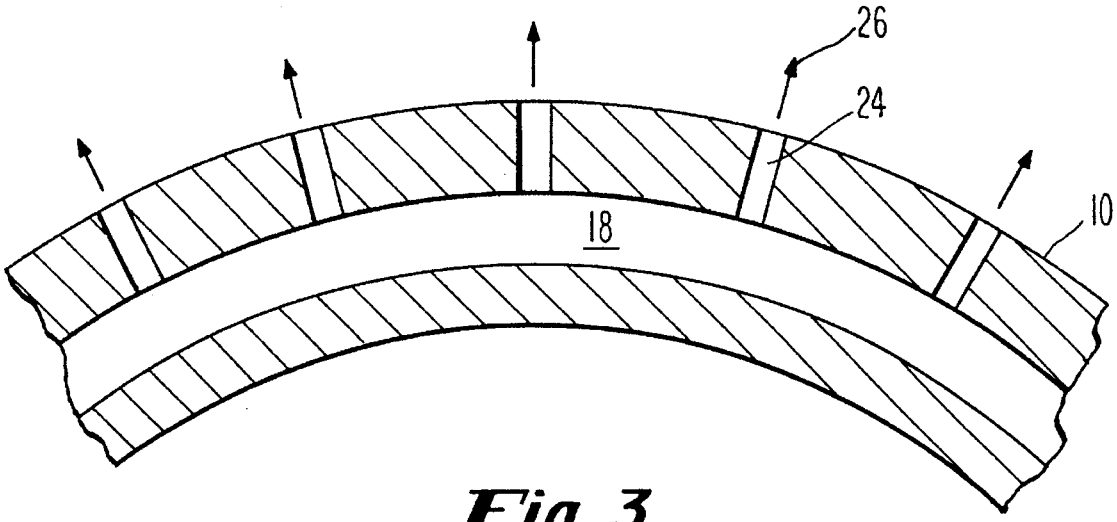
FIG. 3 is a cross-section taken through line III—III shown in FIG. 2.

According to the current invention, the stationary parts of the steam turbine are improved by forming a novel moisture removal slot 16 directly in the blade ring 10 portion of the inner cylinder 3, as shown best in FIGS. 2 and 3. Preferably, the slot 16 extends 360° around the circumference of the blade ring 10. The slot 16 is disposed between the stationary vanes 5 and the surface 12 encircling the tips 26 of the rotating blades 6. Preferably the slot 16 is located adjacent to and immediately upstream from the surface 12.

According to an important aspect of the current invention, the slot 16 has a constricted passage 17 that forms an inlet throat and an enlarged cavity 18 of approximately rectangular cross-section that forms a manifold. The width W' of the slot inlet throat 17 in the axial direction—that is, in the direction parallel to the axis of rotation of the rotor 4—is less than the width W" of the slot manifold 18 in the axial direction. In the preferred embodiment, the axial width W" of the manifold 18 is at least twice as great as the axial width W' of the inlet throat 17.

A plurality of radially oriented discharge holes 24 are formed in the blade ring 10 and extend outward from the slot manifold 18. The discharge holes 24 have inlets 25 formed in the radially outward wall of the slot manifold 18. The discharge holes 24 serve to place the slot 16 in flow communication with the chamber 11 formed in the exhaust housing 7.

In operation, the pressure of the steam 22 flowing in the chamber 11 is less than the pressure of the steam 21 entering the last row of rotating blades 6. As a result, a portion 23 of the steam 21 is drawn into the slot 16 and through the discharge holes 24 to the chamber 11, thereby bypassing the blades 6. As shown in FIG. 2, moisture droplets 26 that form on the blade ring 10 are driven downstream by the flow of steam 21 until they reach the slot inlet throat 17. The moisture droplets 26 are then directed into the slot inlet throat 17 by the flow of the bypass steam 23. After flowing through the inlet throat 17, the droplets 26 collect in the manifold 18, which then distributes the water flow among the discharge holes 24. From the discharge holes 24, the water droplets 26 and bypass steam 23 enter the chamber 11 and mix with the steam 22 directed to the condenser by the exhaust housing 7. Thus, the slot 16 and holes 24 prevent the moisture droplets 26 from impacting the last row of rotating blades 6.

As a result of the narrow width of the slot inlet throat 17, which in the preferred embodiment is only approximately 1.3 cm (0.5 inch), the tendency for the swirling flow of steam 21 to entrain the moisture 26 collected in the slot and carry it to the row of downstream blades is minimized—that is, the inlet throat acts to isolate the moisture collected in the manifold from the swirling steam 21. As previously discussed, entrainment of the moisture 26 into the steam 21 flowing to the last row of blades 6 would defeat the purpose of moisture collection and removal.

The enlarged manifold 18 ensures that, despite the narrowness of the inlet throat 17, there is ample volume in the slot 16 to collect the moisture 26 while it is being distributed to, and discharged by, the holes 24, thereby ensuring no temporary overflow of the slot capacity. Moreover, the enlarged axial width of the manifold 18 provides ample room for the inlets 25 of the holes 24. This allows the use of radial discharge holes 24 having a diameter that is greater than the axial width of the slot inlet throat 17, as shown in FIG. 2—that is, the size of the discharge hole inlets 25 is not limited by the width of the slot inlet 17. Thus, adequate flow capacity to handle the discharge of moisture 26 from the slot 16 is ensured.

The moisture removal slot 16 of the current invention stands in contrast to conventional constant cross-sectional area slots, such as that disclosed in U.S. Pat. No. 3,973,870 (Desai). In such conventional schemes, the use of a narrow slot results in inadequate volume capacity in the slot, as well as discharge hole inlets that are insufficiently large to handle the flow of moisture. Moreover, in such conventional schemes, the use of a wide slot, to overcome the aforementioned disadvantages of a narrow slot, results in moisture being entrained into the steam flow and an excessive power loss due to the amount of steam flow bypassing the last row blades 6.

As previously discussed, in the past, moisture removal just upstream of the last row of rotating blades was typically accomplished by means of a gap formed in a flanged joint along which the outer flow guide and blade ring were secured, such as disclosed in U.S. Pat. Nos. 5,149,248 (Cramer), 4,948,335 (Silvestri), and 3,058,720 (Hart et al.), rather than by a slot formed directly in the blade ring. Since, in this approach, the flanged joint between the outer flow guide and the blade ring must be located upstream of the last row of rotating blades, the outer flow guide will encircle the tips of the rotating blades. Consequently, the outer flow guide must be carefully aligned with respect to the blade ring to ensure that the proper blade tip clearance is maintained. This complicates the assembly of the steam turbine and increases the cost of manufacture.

By contrast, according to the current invention, the moisture removal means is incorporated directly into the blade ring 10. This eliminates the need for a joint between the blade ring and the outer flow guide, allowing the use of an outer flow guide 9 that is integral with the blade ring 10, as shown in FIG. 2, thereby simplifying assembly and manufacture.

Moreover, even if the outer flow guide is not integrally formed, as shown in the embodiment in FIG. 3, forming the moisture removal slot 16 directly in the blade ring 10 according to the current invention allows the blade ring to be extended axially downstream so that it, rather than the outer flow guide 9, forms the surface 12 that encircles the rotating blade tips 26. Thus, the outer flow guide 9 need not be accurately aligned to the blade ring 10, so that assembly and manufacture are again simplified.

Figure 5:
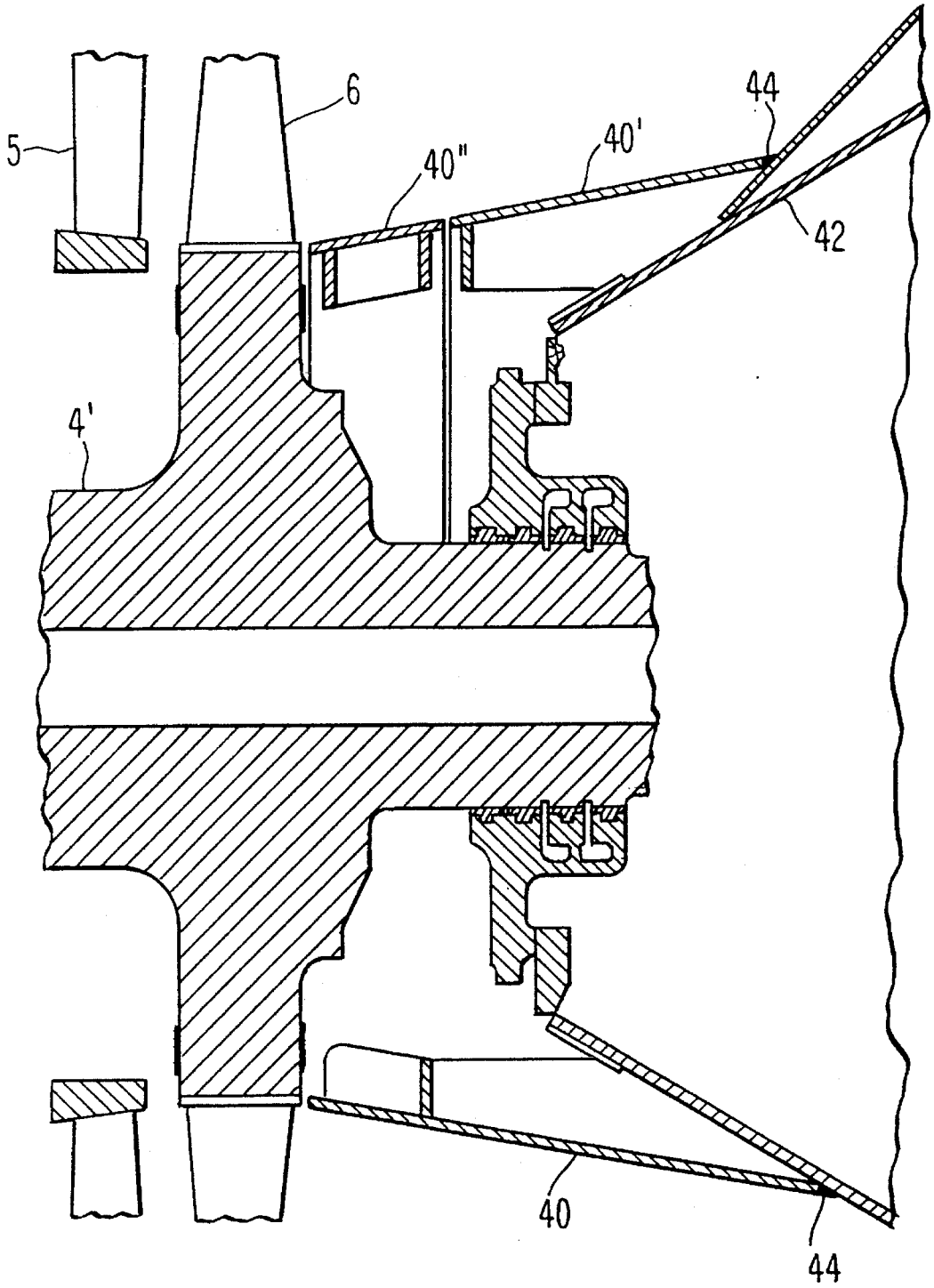
FIG. 5 is a portion of a longitudinal cross-section through a double ended low pressure steam turbine showing an alternate embodiment of the invention.

FIG. 5 shows another embodiment of the current invention in which the stationary parts of the steam turbine are improved by modifying an existing inner flow guide 42 to match a new last row of rotating blades 6. It should be understood that the row of blades 6 shown in FIG. 5 has a hub of larger diameter than the previously used last row of rotating blades. In addition, the rotor 4' has been replaced or modified so the new last row of rotating blades 6 is in a different axial location than those previously used.

According to the current invention, a new inner flow guide 40 is provided that properly mates with the diameter and axial location of the new last row of rotating blades 6—that is, the new inner flow guide 40 has an inlet that has a diameter than matches the hub diameter of the new last row of rotating blades and that is axially located just downstream of the hub of the new last row of rotating blades. According to the current invention, the new inner flow guide 40 is attached to the existing inner flow guide 42 by means of approximately circumferential welds 44. Moreover, as previously discussed, the upper half of the new inner flow guide 40 is axially segmented into upstream and downstream segments 40" and 40', respectively, for ease of disassembly. The upper and low halves of the new inner flow guide may be joined along bolted horizontal flanges, as is conventional.

The present invention may be embodied in other specific forms without departing from the spirit or essential attributes thereof and, accordingly, reference should be made to the appended claims, rather than to the foregoing specification, as indicating the scope of the invention.

We claim:

1. In a steam turbine having (i) a plurality of rows of rotating blades including a new last row of rotating blades which replaces a previously used last row of rotating blades, said new last row of rotating blades having a hub, said hub having a diameter different from the diameter of a hub of the last row of rotating blades previously used in said steam turbine, and (ii) an existing flow guide for guiding a flow of steam away from said previously used last row of rotating blades, said existing flow guide having an inlet diameter matching the hub diameter of said previously used last row of rotating blades, a method for modifying said steam turbine, comprising the step of welding a new flow guide to said existing flow guide, said new flow guide having an inlet diameter that matches said hub diameter of said new last row of rotating blades.

* * * * *